US006378870B1

(12) United States Patent
Sovine

(10) Patent No.: US 6,378,870 B1
(45) Date of Patent: Apr. 30, 2002

(54) APPARATUS AND METHOD FOR DECELERATING PROJECTILES

(75) Inventor: H. Addison Sovine, Provo, UT (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 09/471,626

(22) Filed: Dec. 24, 1999

(51) Int. Cl.[7] ..... F41J 1/12
(52) U.S. Cl. ..... 273/410
(58) Field of Search ..... 273/410, 402–409; 89/36.02

(56) References Cited

U.S. PATENT DOCUMENTS

| | | | |
|---|---|---|---|
| 385,546 | A | 7/1888 | Decembus |
| 694,581 | A | 3/1902 | Reichlin |
| 840,610 | A | 1/1907 | Easdale |
| 941,642 | A | 11/1909 | Maxim |
| 2,013,133 | A | 9/1935 | Caswell |
| 2,411,026 | A | 11/1946 | Conner et al. |
| 2,420,304 | A | 5/1947 | Diem |
| 2,518,445 | A | 8/1950 | Benson |
| 2,631,454 | A | 3/1953 | Shepard et al. |
| 2,772,092 | A | 11/1956 | Nikoden |
| 3,404,887 | A | 10/1968 | Dundr |
| 3,447,806 | A | 6/1969 | Pfaff et al. |
| 3,701,532 | A | 10/1972 | Nikoden |
| 3,737,165 | A | 6/1973 | Pencyla |
| 3,982,761 | A | 9/1976 | DeVogelaere |
| 4,126,311 | A | 11/1978 | Wagoner |
| 4,294,452 | A | 10/1981 | Schlotter et al. |
| 4,317,572 | A | 3/1982 | Iseli |
| 4,445,693 | A | 5/1984 | Angwin |
| 4,458,901 | A | 7/1984 | Wojcinski |
| 4,728,109 | A | 3/1988 | Simonetti |
| 4,786,059 | A | 11/1988 | Barini |
| 4,787,289 | A | 11/1988 | Duer |
| 4,819,946 | A | 4/1989 | Kahler |
| 4,821,620 | A | 4/1989 | Cartee et al. |
| 4,846,043 | A | 7/1989 | Langsam |
| 4,919,437 | A | 4/1990 | Salabe et al. |
| 5,040,802 | A | 8/1991 | Wojcinski et al. |
| 5,070,763 | A | 12/1991 | Coburn |
| 5,085,765 | A | 2/1992 | Salabé et al. |
| 5,113,700 | A | 5/1992 | Coburn |
| 5,121,671 | A | 6/1992 | Coburn |
| D329,680 | S | 9/1992 | Burn |
| 5,171,020 | A | 12/1992 | Wojcinski |
| 5,255,024 | A | 10/1993 | Copius |

(List continued on next page.)

FOREIGN PATENT DOCUMENTS

| | | | |
|---|---|---|---|
| DE | 3212781 | * 12/1985 | ..... 273/410 |
| EP | 399960 | * 12/1985 | ..... 273/410 |
| GB | 2242730 | * 10/1991 | ..... 273/410 |
| WO | 8505672 | * 12/1985 | ..... 273/410 |

OTHER PUBLICATIONS

Super Trap Bullet Containment Systems, Super Trap, ST Bullet Containment Systems, Inc.

The Porta Target Catalog.

Caswell Catalog.

*Primary Examiner*—Mark S. Graham
(74) *Attorney, Agent, or Firm*—Morriss, Bateman, O'Bryant & Compagni, P.C.

(57) ABSTRACT

A method and apparatus for decelerating projectiles includes the use of rubber nuggets. The nuggets are preferably between 15 and 25 millimeters to decrease sluffing when disposed at an incline. Preferably, the nuggets are coated with a fire retardant which promotes adhesion in the presence of heat. If applied in a solution, the fire retardant can also be dried on the rubber nuggets to promote adhesion between the rubber pieces. Furthermore, glue may be mixed with the nuggets or applied with the fire retardant solution to further increase adhesion between the pieces of rubber and promote stability of the layer of rubber nuggets.

29 Claims, 2 Drawing Sheets

U.S. PATENT DOCUMENTS 5,340,117 A 8/1994 Wojcinski
5,400,692 A 3/1995 Bateman
5,405,673 A 4/1995 Seibert
5,435,571 A 7/1995 Wojcinski et al.
5,441,280 A 8/1995 Copius
5,535,662 A 7/1996 Bateman
5,564,712 A 10/1996 Werner
5,607,163 A 3/1997 Nesler
5,811,718 A 9/1998 Bateman
5,822,936 A 10/1998 Bateman
5,848,794 A 12/1998 Wojcinski et al.
6,173,956 B1 * 1/2001 O'Neal ..... 273/410

* cited by examiner

APPARATUS AND METHOD FOR DECELERATING PROJECTILES

BACKGROUND OF THE INVENTION

1. Field of the Invention

The present invention relates to a method of decelerating projectiles. More specifically, the present invention relates to a method for improving the deceleration of projectiles with a rubber trap, and to improving stability of the rubber material.

2. State of the Art

In order to maintain proficiency in the use of firearms, it is common for law enforcement officers and sportsmen to engage in target practice. Target practice was traditionally conducted in settings where preventing ricochets was the primary concern, and the concern over recovery of bullets was secondary or nonexistent. Firing ranges commonly used a large mound of earth to decelerate the bullet after it had passed through the target. Such systems generally prevented injury from ricochets, etc, because the dirt was effective in stopping the bullets.

More recently, however, considerable concern has been raised about the lead contained in the bullet. Though the bullet fired in to the mound of dirt was safely contained from the point of being a moving projectile with a significant amount of inertial momentum, the lead in the bullet was free to leach into the environment. Thus, the more recent trend in shooting ranges has also stressed containment and removal of the bullet to prevent lead contamination of the environment.

In addition to the containment of lead bullets, there is also a desire to build shooting ranges within enclosed structures. For example, many police departments will have a shooting range within the police station. Having the range disposed inside is advantageous because it can be used frequently regardless of the weather and without undue travel time. However, in such ranges, mounds of dirt or similar materials are not generally practical.

The current trend in bullet containment systems has focused on two different types of systems. One kind of containment system, often called a bullet stop and containment chamber. Has a pair of plates which channel bullets toward an opening in a containment chamber. Inside the containment chamber are impact plates which slow the bullet to a stop. (As used herein, bullet includes bullets, shot and other forms of projectiles).

Bullet stop and containment chambers are highly advantageous because the entire deceleration process is controlled by sheets of steel plate. Such a system can withstand hundreds of thousands, if not millions, of rounds without showing excessive wear.

Unfortunately, bullet stop and containment systems which use steel plate containment chambers are also relatively expensive. Numerous sheets of the steel must be welded together to form the chambers. Transportation of the chambers and final construction of the systems can add considerably to cost. Furthermore, it is often difficult to construct such a system in a completed building which was not designed to receive the parts of the system.

Due to these difficulties, there has also been a significant increase in the number of lower-end bullet backstops being formed. Bullet backstops typically include a back wall plate made of steel. The back wall plate is usually disposed transverse to the ground at an angle of about 30–38 degrees. A plurality of support legs extend downwardly from the underside of the back wall plate to the ground.

On an upper side of the wall, a layer of impact material is disposed to provide a medium for decelerating bullets which is several feet thick along the plane the bullet travels. The impact material in such bullet traps has traditionally been dirt or sand. However, over the last decade there has been a trend toward the use of rubber pieces to decelerate the bullets. As a bullet impacts the pieces of rubber, it decelerates sufficiently that if it does impact the back wall plate, any ricocheting will be minimal.

U.S. Pat. No. 5,848,794 to Wojcinski et al (hereinafter "the '794 patent"), discloses an example of a rubber berm bullet trap. FIG. 1 shows a projectile trap assembly, generally indicated at 6 made in accordance with the '794 patent. The trap assembly includes a support frame 10 having a front wall 14 and rear wall 16 supporting an inclined member 11. Supported by the upper surface 12 of inclined member 11 is a particulate flowable granulate material 30.

The upper surface 12 is inclined relative to the line of the projectiles, which typically is substantially parallel to ground. As illustrated, the upper surface 12 is inclined substantially at the angle of repose A of the particulate granulate material, thereby providing a constant depth of granulate material 30 over the entire upper surface 12 of inclined member 11. As shown in FIG. 1, the angle of repose is approximately 38 degrees.

To further facilitate entrapment of the projectiles and to prevent splashing of the granulate particles, projectile trap assembly 6 includes a self-healing member 44 covering the particulate granulate material 30, as illustrated in FIG. 1.

The granulate material 30 typically consists of pieces of rubber having an average size of about 5–7 mm in diameter. Rubber particles of this size provide a sufficiently dense medium to slow entering projectiles when the layer of granulate material is about 2 feet deep.

The '794 patent further teaches the use of an anti-adhesion, fire retardant material to prevent adhesion between the granulate material 30 in the presence of heat and to prevent the rubber material from being ignited by rounds fired into the material.

The granulate material 30 recommended for the bullet trap 6 shown in FIG. 1, is configured to be easily flowable when it is applied to the inclined member 11. This flowability is an important aspect of the trap 6 of FIG. 1 to facilitate removal of the granulate material so that bullets contained therein can be removed and disposed of in accordance with environmental guidelines.

The touted advantages of the configuration discussed above provides countervailing disadvantages. Specifically, the granulate material remains flowable during use of the range. Firing rounds into the small pieces of rubber forming the granulate material 30 causes vibration and splashing. The vibrations and splashing, in turn, cause the granulate material to advance toward the bottom of the inclined member 11. Using the granulate material 30 without the self-healing member 44 can result in uneven layers of the granulate material and requires the floor in front of the trap to be cleaned frequently.

The use of granulate materials, such as the recommended 5–7 millimeters, also increases the risk that the granulate material will be ignited by a bullet fired into the trap 6. Bullets remain hot until after they have come to a complete rest. Because they have a larger effective surface area, smaller pieces of granulate material will potentially ignite more readily than larger pieces of the same material. Thus, a larger amount of fire retardant must be used to achieve the same result.

Thus, there is a need for an improved apparatus and method for bullet deceleration which provides all of the advantages of rubber bullet traps without the disadvantages of the currently available systems.

SUMMARY OF THE INVENTION

Thus, it is an object of the present invention to provide a bullet deceleration backstop which provides increased stability to the rubber material used to decelerate the bullets.

It is another object of the present invention to provide such a bullet deceleration trap in which the pieces of rubber tend to adhere to one another.

It is still yet another object of the present invention to provide such a bullet trap wherein the rubber material is mixed with a fire retardant material which inhibits ignition of the rubber without interfering with adhesion.

It is still yet another object of the present invention to provide such a bullet trap wherein an adhesive is applied to the rubber material to enhance adhesion between adjoining pieces of rubber.

The above and other objects of the invention are realized in specific illustrated embodiments of a bullet deceleration backstop including a deceleration material formed from a synthetic rubber, typically shredded automobile tires.

In accordance with one aspect of the invention, the rubber pieces or nuggets are preferably between 15 and 25 millimeters in diameter. The larger pieces of rubber provide several advantages. First, the rubber nuggets set forth in the present invention have approximately 25 to 100 times greater volume than the pieces of granulate material of the prior art. The increased mass associated with a rubber nugget provides greater stopping power for decelerating a bullet. Second, the larger material is less prone to sluffing and can be stacked at a greater incline without falling. Third, the larger nuggets of material are less prone to ignite from contact with hot metal.

In accordance with another object of the present invention, the rubber nuggets are covered with a fire retardant material. Unlike the prior art, the fire retardant material is selected to not interfere with adhesion between the pieces of rubber. As rounds are fired into the rubber, adjoining pieces are bonded together by the heat, thereby forming a larger rubber nugget.

Adhesion of the rubber nuggets provides several advantages. First, using larger pieces of rubber and having pieces of rubber adhered to one another provides for a more stable mound of rubber. The increased stability of the rubber material enables the mound to be formed at a greater incline without excessive sluffing of the material. This reduces clean-up and eliminates the need to cover the rubber pieces with a self-healing cover. Additionally, being able to place the material at a greater incline decreases the space which is consumed by the backstop. Thus, a shooting range can be contained in a smaller area while still providing an effective mechanism for decelerating the bullets.

Another advantage of allowing adhesion is that rubber material can be maintained for a longer period of time. When a round impacts a mound of rubber, some of the rubber pieces will be sheared or fractured into smaller pieces. By promoting adhesion between the smaller piece (preferably both in the presence of heat and the absence of heat), the pieces of rubber can be held together. More energy is consumed when the bullet impacts the clumps of rubber and the formation of new clumps by heat from the bullet prolongs the usefulness of the rubber nuggets as a bullet deceleration material.

In accordance with still another aspect of the invention, a glue added to the rubber nuggets. Preferably, the glue is sprayed on the pieces of rubber along with the fire retardant. As the glue dries, it holds the rubber nuggets together. This further facilitates stability of the rubber trap and improves bullet deceleration.

In accordance with another aspect of the invention, the glue is selected to have adhesive properties when it is moistened. Periodically spraying the rubber with water causes the glue to adhere the rubber pieces to one another and prolong the life of the rubber nuggets in the trap.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
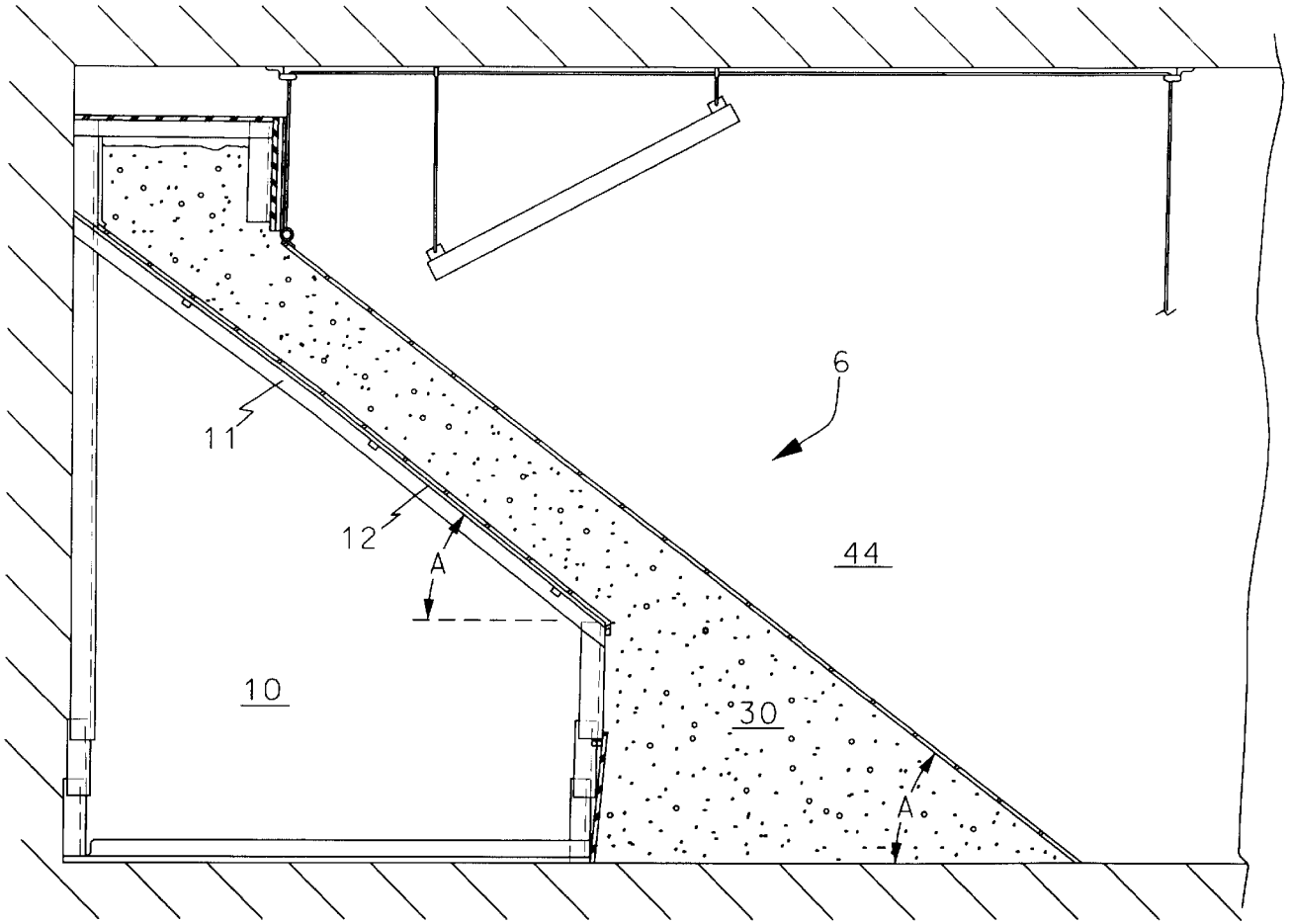
FIG. 1 (Prior Art)
FIG. 1 shows a side view of a bullet deceleration trap made in accordance with the teachings of the prior art.

Referring to FIG. 1, there is shown a prior art bullet deceleration trap. The trap decelerates bullets by providing a granulate material 30, i.e. shredded rubber, with a diameter of about 5 to 7 millimeters. As a bullet is fired into the granulate material 30 the force exerted to move the granulate material out of the bullet's path decelerates the bullet and brings it to a stop.

To prevent the granulate material 30 from igniting and causing a fire which is difficult to control, a fire retardant, anti-adhesion compound is mixed with the granulate material 30. The anti-adhesion material prevents the granulate material 30 from adhering together in response to heat from the bullet.

The teachings of the prior art, however, provide several distinct disadvantages. First, the very small pieces of rubber do not have a significant degree of stopping power due to their small size. Second, the small pieces of rubber tend to splatter and sluff downwardly during use, thereby limiting the angle of incline of incline at which the backstop assembly may be placed. Third, the small pieces of rubber are more prone to igniting.

Figure 2:
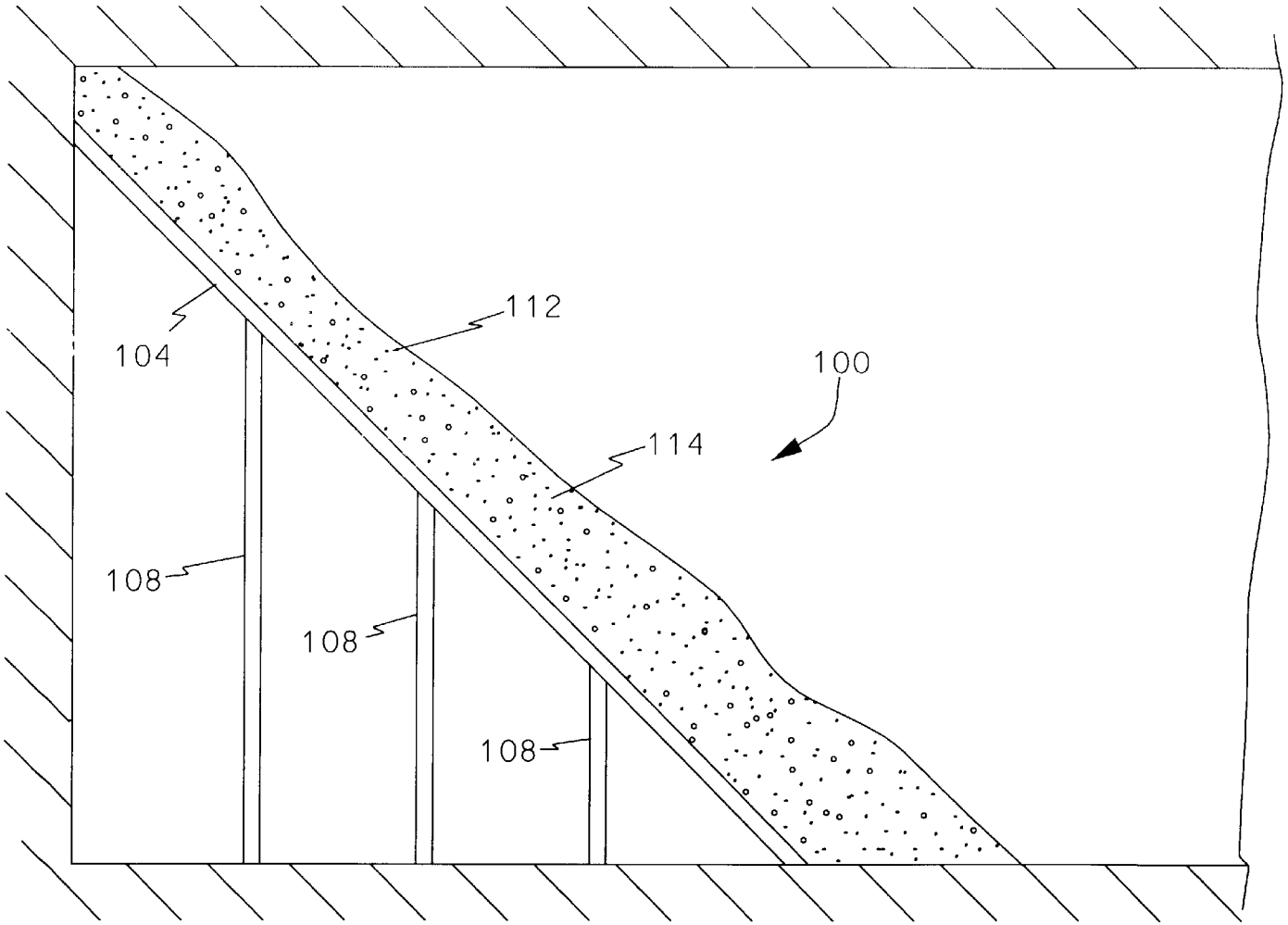
FIG. 2 shows a side view of a bullet deceleration trap made in accordance with the principles of the present invention.

Turning now to FIG. 2, there is shown a side view of a bullet deceleration trap, generally indicated at 100, made in accordance with the principles of the present invention. The deceleration trap 100 includes an inclined surface 104 which is typically made of plate steel. The inclined surface 104 is supported by a plurality of legs 108. The legs 108 may be adjustable, or may be welded in place.

Disposed on the inclined surface 104 is a layer 112 of rubber nuggets 114. Preferably, the layer 112 of rubber nuggets 114 is about 2 feet deep. As shown in FIG. 2, the incline surface 104 is disposed at an angle of 45 degrees. Thus, the layer 112 of rubber nuggets 114 is also disposed at 45 degrees.

Unlike the prior art, the rubber nuggets are preferably 15 to 25 millimeters in diameter. Thus, the individual rubber nuggets 114 are between about 27 and 100 times the volume of the 5 to 7 millimeter rubber pieces advocated by the prior art. The larger size of the rubber nuggets 114 enables the inclined surface 104 to be disposed at a greater angle than would be feasible with the prior art granular material without rubber sluffing off. Thus, while the layer 112 shown in FIG. 2 is at 45 degrees, disposing the material of the prior art at such an angle would provide a very unstable layer would tend to flow downwardly. The ability to dispose the inclined surface 104 at a greater angle enables a bullet trap 100 to be disposed in a smaller area than is available in the prior art.

Because of the decrease in surface area to volume, the larger size of the rubber nuggets 114 decreases the risk of the rubber being ignited by hot metal. However, to further prevent ignition, the rubber nuggets 114 are mixed with a fire retardant material. In the '794 patent, it is taught to provide a fire retardant material which inhibits adhesion between the granulate particles.

Presumably, the anti-adhesion teaching of the prior art is based on the presumption that clumps of rubber pieces are undesirable. In accordance with the teachings of the present invention, clumps of rubber are desirable because they help stabilize the layer 112 of rubber nuggets 114 and provide better stopping power for bullets. Thus, the fire retardant is selected so that it does not interfere with adhesion between the pieces of rubber.

In accordance with a preferred embodiment of the present invention, it has been found desirable to utilize a fire retardant material, such as borax, which actually tends to promote adhesion between the rubber nuggets 114. Ideally, 2 to 4 ounces of borax in a saturated solution is used for every cubic foot of rubber nuggets used on the trap.

As bullets are fired into the layer 112 of rubber nuggets 114, the heat from the bullets tends to cause adhesion between the rubber nuggets. The borax facilitates this adhesion, forming clumps of rubber nuggets 114 which further stabilize the layer 112. Over time, many clumps are formed by the rubber nuggets 114. When a clump is impacted by a round, the impact will tend to break the clump apart. This, of course, consumes energy from the bullet and results in quicker deceleration. After the initial impact, the heat from the bullet facilitates the formation of other clumps.

In addition to promoting adhesion between the rubber nuggets 114 in the presence of heat, the borax can also facilitate adhesion when it is applied to the rubber nuggets in a solution. (As used herein, solution includes liquid forms such as solutions and suspensions.) As the solution dries, the borax coats the rubber nuggets 114 and tends to hold them together. In some situations, the bond created by the dried borax is sufficiently strong that a person can stand on the layer of rubber nuggets inclined at 30–38 degrees without any significant downward sluffing.

To further facilitate the ability of the rubber nuggets 114 to avoid sluffing downwardly, the rubber nuggets can be mixed with a material which further promotes adhesion between the nuggets and thereby stabilizes the mound. Thus, in accordance with one aspect of the invention, the rubber nuggets 114 are also coated with a glue, such as titebond aliphatic resin glue, which will bond the rubber nuggets together.

Preferably, the borax and the glue are applied in a common solution. The borax in the solution breaks down any surface tension and promotes the liquid to cover all parts of the material, even if foreign material such as oil, lead or other contaminants are present. As the solution dries, the borax and glue bond the rubber nuggets 114 together. This, in turn, provides additional resistance to downward sluffing by the nuggets and further promotes projectile deceleration.

In addition to the above, the bonding of the rubber nuggets 114 helps to prolong the usefulness of the rubber. As bullets are fired into the layer 112 of the rubber nuggets 114, the bullets will cause some pieces of rubber to fragment, while the heat causes other pieces to adhere to one another. Periodically spraying the rubber nuggets 114 with water causes the glue to adhere the rubber pieces to one another and prolong the life of the rubber nuggets in the trap.

With almost any bullet trap, the bullet decelerating material must be periodically cleaned to remove bullets which have been fired into the trap. The teachings of the prior art imply that it is preferable to prevent adhesion to facilitate cleaning of the bullets from the granulate material, in addition to the claim that it enhances bullet stopping effectiveness. Because of the small size of the pieces of rubber they can be vacuumed from the trap and screened to remove the bullets.

In accordance with the principles of the present invention, it has been found that using the larger rubber nuggets does not hamper cleaning while providing the improvements discussed above. If large clumps of nuggets form due to adhesion, an auger (not shown) is used to remove the material from the inclined surface 104. The auger will also break the clumps and allow processing of the rubber to remove the bullets. Bullet removal can be accomplished by screening the nuggets 114, or by other processing methods. The cleaned rubber nuggets 114 may then be returned to the incline surface where they are then coated with the borax/glue solution and placed in service.

Thus there is disclosed an improved apparatus and method for decelerating projectiles. Those skilled in the art will appreciate numerous modifications which can be made without departing from the scope and spirit of the present invention. The appended claims are intended to cover such modifications.

What is claimed is:

1. A method for forming a bullet trap, the method comprising:

selecting an inclined surface;

selecting pieces of rubber having an average diameter of between about 15 and 25 millimeters;

disposing the pieces of rubber to form a layer on the inclined surface; and applying a fire retardant to the pieces of rubber which will not inhibit adhesion of the pieces of rubber in the presence of heat.

2. The method according to claim 1, wherein the method comprises applying a fire retardant to the pieces of rubber which promotes adhesion between the pieces of rubber.

3. The method according to claim 2, wherein the method comprises selecting borax and mixing the borax with the pieces of rubber.

4. The method according to claim 1, wherein the method comprises forming a solution containing the fire retardant and mixing the solution with the pieces of rubber.

5. The method according to claim 4, wherein the solution is sprayed on the pieces of rubber.

6. The method according to claim 1, wherein the method further comprises applying glue to the pieces of rubber.

7. The method according to claim 6, wherein the glue is applied to the pieces of rubber in a solution.

8. The method according to claim 7, wherein the glue is mixed with the fire retardant.

9. The method according to claim 6, wherein the method further comprises periodically rewetting the pieces of rubber to cause the glue to adhere pieces of rubber together.

10. A method for forming a bullet trap, the method comprising:

forming an inclined surface;

disposing a plurality of pieces of rubber on the inclined surface to form a layer of rubber on the inclined surface; and selecting a fire retardant which promotes adhesion between pieces of rubber under heat; and mixing the fire retardant with the pieces of rubber.

11. The method according to claim 10, wherein the method comprises selecting borax as the fire retardant.

12. The method according to claim 10, where the method further comprises selecting pieces of rubber having an average diameter of at least 15 millimeters.

13. The method according to claim 12, wherein the method comprises selecting pieces of rubber having an average diameter of between 15 millimeters and 25 millimeters.

14. The method according to claim 10, wherein the method further comprises mixing the fire retardant in a solution and applying the solution to the pieces of rubber.

15. The method according to claim 10, further comprising mixing the pieces of rubber with glue.

16. The method according to claim 15, wherein the glue is mixed in a solution and then applied to the pieces of rubber.

17. The method according to claim 15, wherein the method further comprises periodically wetting the glue to cause the glue to adhere pieces of rubber together.

18. A method for forming a bullet trap, the method comprising;

forming an inclined surface;

selecting pieces of rubber and disposing the pieces of rubber on the incline surface to form an inclined layer of rubber having an exposed surface disposed generally parallel to the inclined surface; and selecting a glue capable of adhering pieces of rubber together and mixing the glue with the pieces of rubber to maintain the inclined layer of rubber.

19. The method according to claim 18, wherein the method comprises mixing the glue in a solution and applying the solution to the pieces of rubber.

20. The method according to claim 18, wherein the pieces of rubber are selected to have an average diameter between about 15 millimeters and 25 millimeters.

21. The method according to claim 18, wherein the method further comprises applying a fire retardant to the pieces of rubber.

22. The method according to claim 18 wherein clumps of rubber are formed by adhering pieces of rubber together and wherein the method further comprises removing the pieces of rubber from the inclined surface with an auger which will break at least some of the clumps of rubber into smaller pieces.

23. A method for forming a bullet trap, the method comprising;

forming an inclined surface;

selecting pieces of rubber and disposing the pieces of rubber on the incline surface to form an inclined layer of rubber having an exposed surface disposed generally parallel to the inclined surface;

selecting a glue capable of adhering pieces of rubber together and mixing the glue with the pieces of rubber to maintain the inclined layer of rubber; and applying a fire retardant to the pieces of rubber, wherein the fire retardant is mixed in a solution and applied to the pieces of rubber so that the solution dries on the pieces of rubber.

24. A method for forming a bullet trap, the method comprising;

forming an inclined surface;

selecting pieces of rubber and disposing the pieces of rubber on the incline surface to form an inclined layer of rubber having an exposed surface disposed generally parallel to the inclined surface;

selecting a glue capable of adhering pieces of rubber together and mixing the glue with the pieces of rubber to maintain the inclined layer of rubber; and applying a fire retardant to the pieces of rubber, wherein the fire retardant is selected from fire retardants which will not inhibit adhesion between the pieces of rubber in the presence of heat.

25. A bullet trap for decelerating bullets, the trap comprising:

an inclined surface;

a layer disposed on the inclined surface, the layer being formed from pieces of rubber material, the pieces of rubber material having an average diameter of between about 15 and 25 millimeters; and a fire retardant which does not inhibit the adhesion of pieces of rubber to one another in the presence of heat.

26. The bullet trap according to claim 25, wherein the fire retardant is mixed with the pieces of rubber material, wherein the fire retardant is selected from the group consisting of fire retardants which do not promote adhesion of the pieces of rubber material under heat.

27. The bullet trap according to claim 25, wherein the bullet trap further comprises glue mixed with the pieces of rubber material.

28. A bullet trap for receiving bullets and decelerating the same, the bullet trap comprising:

an inclined surface;

a layer disposed on the inclined surface, the layer being formed by pieces of rubber material; and glue mixed with the pieces of rubber material forming the layer for holding pieces of rubber material together to form an inclined rubber surface substantially held in place by the glue.

29. A bullet trap for decelerating bullets, the trap comprising:

an inclined surface;

a layer disposed on the inclined surface, the layer being formed from pieces of rubber material; and a solution containing fire retardant applied to the pieces of rubber such that when the solution dries, the pieces of rubber are adhered together.

* * * * *

UNITED STATES PATENT AND TRADEMARK OFFICE

CERTIFICATE OF CORRECTION

PATENT NO. : 6,378,870 B1
APPLICATION NO. : 09/471626
DATED : April 30, 2002
INVENTOR(S) : H. Addison Sovine It is certified that error appears in the above-identified patent and that said Letters Patent is hereby corrected as shown below:

Column 4, Line 52 reads "... of incline of incline at which the backstop ..."; should read "... of incline at which the backstop ..."

Column 5, Line 11 reads "would tend to flow ..."; should read "that would tend to flow ..."

Column 7, Line 40 reads "rubber on the incline surface ..."; should read "rubber on the inclined surface ..."

Column 8, Line 2 reads "rubber on the incline surface ..."; should read "rubber on the inclined surface ..."

Column 8, Line 16 reads "rubber on the incline surface ..."; should read "rubber on the inclined surface ..."

Signed and Sealed this

Third Day of February, 2009

JOHN DOLL
*Acting Director of the United States Patent and Trademark Office*